US011852337B2

(12) United States Patent
Park et al.

(10) Patent No.: US 11,852,337 B2
(45) Date of Patent: Dec. 26, 2023

(54) FLAME HOLE UNIT STRUCTURE OF COMBUSTION APPARATUS

(71) Applicant: KYUNGDONG NAVIEN CO., LTD., Pyeongtaek-si (KR)

(72) Inventors: Jun Kyu Park, Seoul (KR); Hyun Muk Lim, Seoul (KR)

(73) Assignee: Kyungdong Navien Co., Ltd., Gyeonggi-do (KR)

( * ) Notice: Subject to any disclaimer, the term of this patent is extended or adjusted under 35 U.S.C. 154(b) by 718 days.

(21) Appl. No.: 16/647,709

(22) PCT Filed: Sep. 14, 2018

(86) PCT No.: PCT/KR2018/010852
§ 371 (c)(1),
(2) Date: Mar. 16, 2020

(87) PCT Pub. No.: WO2019/059592
PCT Pub. Date: Mar. 28, 2019

(65) Prior Publication Data

US 2020/0278113 A1 Sep. 3, 2020

(30) Foreign Application Priority Data

Sep. 19, 2017 (KR) ..... 10-2017-0120538

(51) Int. Cl.
*F23D 14/76* (2006.01)
*F23D 14/58* (2006.01)
*F23D 14/70* (2006.01)

(52) U.S. Cl.
CPC ..... *F23D 14/76* (2013.01); *F23D 14/58* (2013.01); *F23D 14/70* (2013.01); *F23D 2209/20* (2013.01)

(58) Field of Classification Search
CPC ..... F23D 14/586
See application file for complete search history.

(56) References Cited

U.S. PATENT DOCUMENTS 5,318,438 A 6/1994 Sugahara et al.
6,746,236 B2 * 6/2004 Kuriyama ..... F23D 14/04 431/278

(Continued)

FOREIGN PATENT DOCUMENTS

CN 101233365 A 7/2008
CN 101603687 A 12/2009

(Continued)

OTHER PUBLICATIONS

Office Action dated Mar. 28, 2023 in U.S. Appl. No. 17/255,936.

*Primary Examiner* — Avinash A Savani
*Assistant Examiner* — Deepak A Deean

(57) ABSTRACT

A flame hole unit structure of a combustion apparatus provided with a plurality of flame holes for forming a flame comprises: a lean flame hole unit including, as a flame hole for jetting lean gas, at least one lean flame hole extending along the longitudinal direction which is a direction perpendicular to the jetting direction of the lean gas; and a rich flame hole unit including, as a flame hole for jetting rich gas, a pair of rich flame hole provided on both sides of the lean flame hole unit with respect to a width direction which is a direction perpendicular to the jetting direction and the longitudinal direction and extending along a direction parallel to the longitudinal direction. When a region, which is defined at the top end of the rich flame hole by means of first and second lines that are arbitrary imaginary lines across the rich flame hole, and by means of a pair of rich flame hole walls spaced apart along the width direction and forming a part of the rich flame hole between the first and second lines, is referred to as a reference region, then the rich flame hole includes a region which is designed such that, at the time of generating the flame by the rich gas, between arbitrary reference regions of the same size, the sum of the amounts (Continued)

of heat transferred to the pair of rich flame hole walls forming each reference region is substantially the same.

12 Claims, 11 Drawing Sheets

(56) References Cited

U.S. PATENT DOCUMENTS

| | | | | |
|---|---|---|---|---|
| 6,786,717 | B2 * | 9/2004 | Shimazu | F23D 14/04 431/278 |
| 9,091,436 | B2 * | 7/2015 | Homma | F23D 14/46 |
| 9,115,888 | B2 | 8/2015 | Wada et al. | |
| 9,228,742 | B2 * | 1/2016 | Akiyama | F23D 14/02 |
| 9,927,143 | B2 * | 3/2018 | Naitoh | F23D 14/02 |
| 2003/0143507 | A1 * | 7/2003 | Kuriyama | F23D 14/70 431/354 |
| 2003/0148241 | A1 | 8/2003 | Shimazu et al. | |
| 2008/0160467 | A1 | 7/2008 | Shimazu et al. | |
| 2011/0053105 | A1 | 3/2011 | Kim | |
| 2011/0297059 | A1 | 12/2011 | Shimizu | |
| 2012/0244482 | A1 * | 9/2012 | Homma | F23D 14/105 431/278 |
| 2012/0308945 | A1 | 12/2012 | Wada et al. | |
| 2013/0149653 | A1 * | 6/2013 | Fukunishi | F23D 14/586 431/278 |
| 2013/0171576 | A1 * | 7/2013 | Akiyama | F23D 14/105 431/354 |
| 2013/0247844 | A1 | 9/2013 | Cheng et al. | |
| 2015/0184849 | A1 * | 7/2015 | Akagi | F23D 14/46 431/278 |
| 2015/0253035 | A1 * | 9/2015 | Naitoh | F23D 14/586 122/18.4 |
| 2015/0369478 | A1 | 12/2015 | Akagi | |
| 2018/0031230 | A1 * | 2/2018 | Naitoh | F23D 14/60 |

FOREIGN PATENT DOCUMENTS

| | | | |
|---|---|---|---|
| CN | 101910725 | A | 12/2010 |
| CN | 102338383 | A | 2/2012 |
| CN | 103185339 | A | 7/2013 |
| CN | 103277812 | A | 9/2013 |
| CN | 104033927 | A | 9/2014 |
| JP | 07-332618 | A | 12/1995 |
| JP | 09-042616 | A | 2/1997 |
| JP | 2003-269705 | A | 9/2003 |
| JP | 2003-269707 | A | 9/2003 |
| JP | 2003-329220 | A | 11/2003 |
| JP | 3671922 | B2 | 7/2005 |
| JP | 2006-170594 | A | 6/2006 |
| JP | 2008-185240 | A | 8/2008 |
| JP | 2010-261615 | A | 11/2010 |
| JP | 2011-127863 | A | 6/2011 |
| JP | 2011-191037 | A | 9/2011 |
| JP | 2012-127595 | A | 7/2012 |
| JP | 2012-202585 | A | 10/2012 |
| JP | 5300579 | B2 | 9/2013 |
| JP | 2013210164 | A | 10/2013 |
| JP | 2015-166660 | A | 9/2015 |
| JP | 6174450 | B2 | 8/2017 |
| KR | 10-2020-0002592 | A | 1/2020 |
| WO | 2020-004829 | A | 1/2020 |

* cited by examiner

FLAME HOLE UNIT STRUCTURE OF COMBUSTION APPARATUS

TECHNICAL FIELD

The present disclosure relates to a flame hole structure of a combustion apparatus. More particularly, the present disclosure relates to a flame hole structure of a combustion apparatus including a plurality of flame holes for forming a flame.

BACKGROUND ART

A gas combustion apparatus refers to an apparatus for burning a supplied fuel gas to generate heat. When the fuel gas is burned in the combustion apparatus, NOx (nitrogen oxide) is generated. NOx not only causes acid rain, but also irritates eyes and a respiratory organ and kills plants. Therefore, NOx is regulated as a main air pollutant. When a fuel gas with a relatively low fuel ratio (hereinafter, referred to as a lean gas) is used in the combustion apparatus, emission of NOx may be reduced. However, when the lean gas is used, the burning velocity is reduced so that the combustion stability is weakened, and emission of carbon monoxide (CO) is increased.

Accordingly, a lean-rich burner for reducing emission of NOx and enhancing combustion stability has been developed. The lean-rich burner refers to a burner configured such that a rich flame is located in an appropriate position around a lean flame. The rich flame refers to a flame generated when a fuel gas with a relatively high fuel ratio (hereinafter, referred to as a rich gas) is burned. In the lean-rich burner, a tertiary flame is formed while unburned fuel of the rich flame reacts with excess air of the lean flame, and therefore the combustion stability of the lean flame may be enhanced. This effect is called a flame stabilizing effect.

However, due to recent strict NOx regulation standards, it is difficult to satisfy the NOx regulation standards even through the lean-rich burner. When the fuel ratio of the rich gas in the lean-rich burner is decreased, emission of NOx may be reduced. However, in this case, the combustion stability of the rich flame is weakened.

Accordingly, to decrease the fuel ratio of the rich gas in the lean-rich burner to reduce emission of NOx and achieve a strong flame stabilizing effect, a combustion apparatus having a modified structure of a flame hole through which a lean gas and a rich gas are released has been developed in recent years.

FIG. 1 is a schematic plan view illustrating flame hole structures of conventional lean-rich burners. In FIG. 1, slant lines represent flames. As illustrated in FIG. 1 (*a*), the conventional flame hole structures include, around a lean flame hole 1 for releasing a lean gas, rich flame holes 2 for releasing a rich gas. Further, a binding plate 3 for binding the lean flame hole 1 and the rich flame holes 2 is placed at upper ends of the lean flame hole 1 and the rich flame holes 2. Alternatively, as illustrated in FIG. 1 (*b*), the conventional flame hole structures include a lean flame hole 4 for releasing a lean gas and rich flame holes 5 and 6 disposed to surround the periphery of the lean flame hole 4.

However, according to the flame hole structures illustrated in FIGS. 1 (*a*) and (*b*), a lifting phenomenon occurs in the flames generated in regions A and B so that the flames are unstable and therefore a flame stabilizing effect is deteriorated. Here, the lifting phenomenon refers to a phenomenon in which the release velocity of a fuel gas is higher than the burning velocity of the fuel gas so that a flame rises off from a flame hole. The flames in which the lifting occurs are unstable and are easily extinguished, or a large amount of carbon monoxide is generated.

DISCLOSURE

Technical Problem

The present disclosure has been made to solve the above-mentioned problems. An aspect of the present disclosure provides a flame hole structure of a combustion apparatus for allowing a flame to be uniformly generated in substantially all regions of a flame hole, thereby reducing emission of NOx and enhancing a flame stabilizing effect.

Technical Solution

In an embodiment, a flame hole structure of a combustion apparatus having a plurality of flame holes for forming a flame includes a lean flame hole part having at least one lean flame hole extending along a lengthwise direction that is a direction perpendicular to a release direction of a lean gas, as a flame hole to release the lean gas and a rich flame hole part having a pair of rich flame holes provided on opposite sides of the lean flame hole part with respect to a width direction that is a direction perpendicular to the release direction and the lengthwise direction, the pair of rich flame holes extending along a direction parallel to the lengthwise direction, as flame holes to release a rich gas. A reference region refers to a region defined at an upper end of each rich flame hole by first and second lines that are any virtual lines across the rich flame hole and a pair of rich flame hole walls that are spaced apart from each other along the width direction and that form a portion of the rich flame hole between the first and second lines, and the rich flame hole includes, between any reference regions having the same size, a region designed such that when a flame by the rich gas is generated, the sum of amounts of heat transferred to a pair of rich flame hole walls that form each reference region is substantially the same.

In another embodiment, a flame hole structure of a combustion apparatus having a plurality of flame holes for forming a flame includes a lean flame hole part having at least one lean flame hole extending along a lengthwise direction that is a direction perpendicular to a release direction of a lean gas, as a flame hole to release the lean gas and a rich flame hole part having a pair of rich flame holes provided on opposite sides of the lean flame hole part with respect to a width direction that is a direction perpendicular to the release direction and the lengthwise direction, the pair of rich flame holes extending along a direction parallel to the lengthwise direction, as flame holes to release a rich gas. The lean flame hole includes at least one bent lean flame hole portion bent toward the center of the lean flame hole part along the width direction and horizontal lean flame hole portions provided on opposite sides of the bent lean flame hole portion with respect to the direction parallel to the lengthwise direction and extending along the direction parallel to the lengthwise direction. The rich flame hole includes at least one protruding rich flame hole portion protruding toward the bent lean flame hole portion to correspond to the bent lean flame hole portion and horizontal rich flame hole portions provided on opposite sides of the protruding rich flame hole portion with respect to the direction parallel to the lengthwise direction and extending along the direction parallel to the lengthwise direction to correspond to the horizontal lean flame hole portions. In a region extending from at least any one horizontal rich flame hole portion to another horizontal rich flame hole portion through the adjacent protruding rich flame hole portion, the rich flame hole part is provided to be spaced apart from the lean flame hole part by substantially the same interval.

In another embodiment, a flame hole structure of a combustion apparatus having a plurality of flame holes for forming a flame includes a lean flame hole part extending along a lengthwise direction and having at least one lean flame hole that releases a lean gas and a rich flame hole part having a pair of rich flame holes provided on opposite sides of the lean flame hole part with respect to a width direction associated with the lengthwise direction, the pair of rich flame holes extending along a direction parallel to the lengthwise direction to release a rich gas. A reference region refers to a region defined at an upper end of each rich flame hole by first and second lines that are any virtual lines across the rich flame hole and a pair of rich flame hole walls that are spaced apart from each other along the width direction and that form a portion of the rich flame hole between the first and second lines, and between any reference regions having the same size, the rich flame hole is designed such that when a flame by the rich gas is generated, the sum of amounts of heat transferred to physical boundaries that define each reference region is substantially the same.

In another embodiment, a flame hole structure of a combustion apparatus having a plurality of flame holes for forming a flame includes a lean flame hole part extending along a lengthwise direction and having at least one lean flame hole that releases a lean gas and a rich flame hole part having a pair of rich flame holes provided on opposite sides of the lean flame hole part with respect to a width direction associated with the lengthwise direction, the pair of rich flame holes extending along a direction parallel to the lengthwise direction to release a rich gas. A reference region refers to a region defined at an upper end of each rich flame hole by first and second lines that are any virtual lines across the rich flame hole and a pair of rich flame hole walls that are spaced apart from each other along the width direction and that form a portion of the rich flame hole between the first and second lines, and between any reference regions having the same size, the rich flame hole is designed such that the sum of lengths of upper ends of a pair of rich flame hole walls that form each reference region is substantially the same.

In another embodiment, a flame hole structure of a combustion apparatus having a plurality of flame holes for forming a flame includes a lean flame hole part extending along a lengthwise direction and having at least one lean flame hole that releases a lean gas and a rich flame hole part having a pair of rich flame holes provided on opposite sides of the lean flame hole part with respect to a width direction associated with the lengthwise direction, the pair of rich flame holes extending along a direction parallel to the lengthwise direction to release a rich gas. A reference region refers to a region defined at an upper end of each rich flame hole by first and second lines that are any virtual lines across the rich flame hole and a pair of rich flame hole walls that are spaced apart from each other along the width direction and that form a portion of the rich flame hole between the first and second lines, and between any reference regions having the same size, the rich flame hole is designed such that when a flame by the rich gas is generated, a burning velocity of the rich gas in each reference region is substantially the same.

In another embodiment, a flame hole structure of a combustion apparatus having a plurality of flame holes for forming a flame includes a lean flame hole part having a lean flame hole formed in a spacing space between a plurality of lean plates as a flame hole to release a lean gas, the plurality of lean plates being disposed to be spaced apart from each other while facing each other along a width direction that is a direction that is perpendicular to a release direction of the lean gas and is also perpendicular to a lengthwise direction that is a direction perpendicular to the release direction and a rich flame hole part having rich flame holes provided on opposite sides of the lean flame hole part with respect to the width direction as flame holes to release a rich gas, each rich flame hole being formed in a spacing space between first and second rich plates disposed to be spaced apart from each other at a predetermined interval while facing each other along the width direction. The plurality of lean plates include at least one bent lean plate portion bent toward the center of the lean flame hole part along the width direction and horizontal lean plate portions extending from opposite sides of the bent lean plate portion with respect to a direction parallel to the lengthwise direction along the direction parallel to the lengthwise direction. The first and second rich plates include at least one first protruding rich plate portion and at least one second protruding rich plate portion protruding toward the bent lean plate portion to correspond to the bent lean plate portion and first and second horizontal rich plate portions extending from opposite sides of the first and second protruding rich plate portions with respect to the direction parallel to the lengthwise direction along the direction parallel to the lengthwise direction to correspond to the horizontal lean plate portions. A length of a vertical line drawn from any point of at least one first horizontal rich plate portion toward the second horizontal rich plate portion is designed to be substantially the same as a length of a vertical line drawn from any point of the adjacent first protruding rich plate portion toward the second protruding rich plate portion.

Advantageous Effects

When the combustion apparatus including the flame hole structure according to the present disclosure is used, a stable flame may be maintained in substantially all regions of each flame hole, and thus a uniform flame stabilizing effect may be achieved, with a reduction in NOx.

MODE FOR INVENTION

Figure 1:
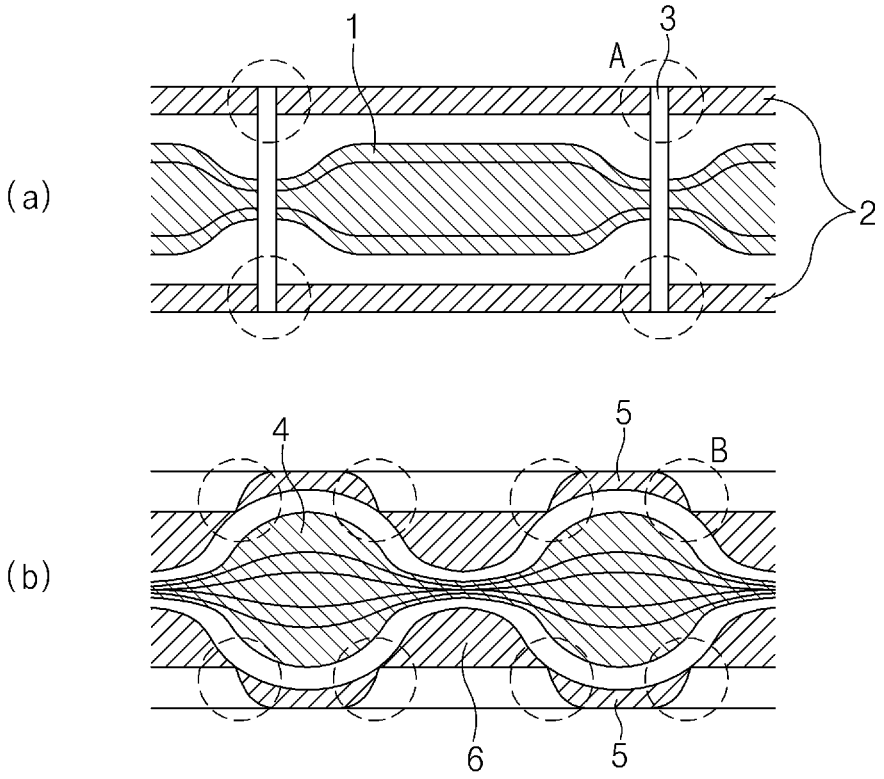
FIG. 1 is a schematic plan view illustrating flame hole structures of conventional lean-rich burners.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

Through repeated experiments and studies for solving the above-mentioned problems, the inventors of the present disclosure have found the cause of the lifting phenomenon in the regions A and B of FIG. 1. There may be many causes, and one of them is that part of heat generated when a fuel gas is burned is transferred to the outside so that the burning velocity is reduced. More specific description will be given with reference to FIG. 2.

Figure 2:
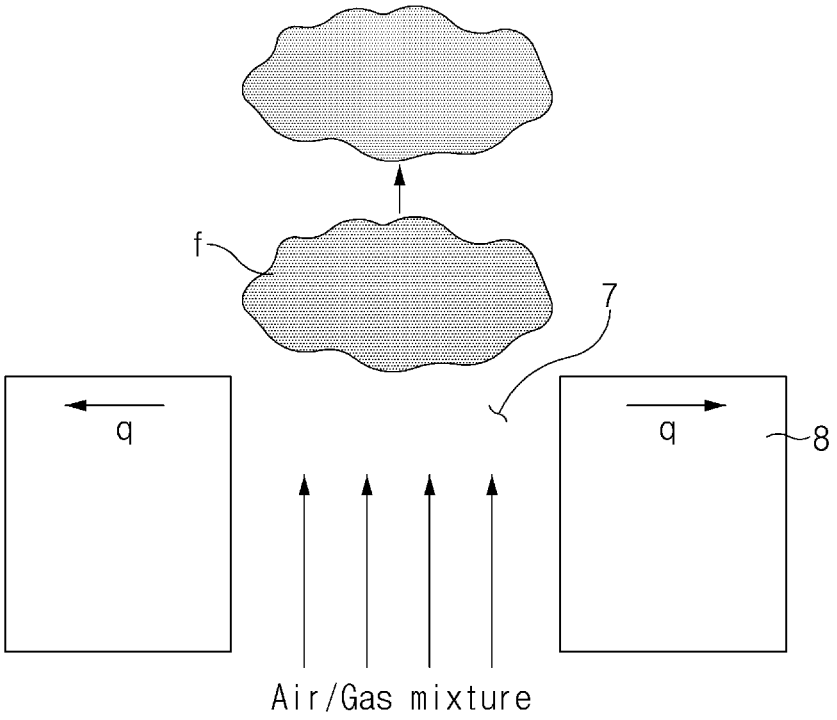
FIG. 2 is a schematic view illustrating a section of a flame hole structure to describe a lifting phenomenon.

FIG. 2 is a schematic view illustrating a section of a flame hole structure to describe a lifting phenomenon. As illustrated in FIG. 2, for example, when a rich gas is released through a rich flame hole 7, a rich flame F is generated around a flame hole wall 8 that forms the rich flame hole 7. At this time, when the amount of heat q transferred to the flame hole wall 8 increases, the release velocity of the rich gas becomes higher than the burning velocity of the rich gas as the burning velocity decreases. Therefore, a problem may arise in which the rich flame F rises off the rich flame hole 7 and is immediately extinguished.

Accordingly, in the case of the region A in FIG. 1 (*a*), a lifting phenomenon is more likely to occur than in the other region because heat is able to be transferred to the binding plate 3 placed at the upper ends as well as the flame hole wall that forms the flame hole. Therefore, a problem may arise in which when a fuel gas is released under the same condition, no flame is generated only in the region A and a flame stabilizing effect is weakened in the region A.

Furthermore, even in the case of the region B in FIG. 1 (*b*), in the portion where the rich flame hole 5 and the rich flame hole 6 are disconnected from each other, the amount of heat transferred to the flame hole wall per unit heating value of the rich gas is relatively larger than in the other region, and therefore a problem may arise in which a lifting phenomenon easily occurs in the region B.

Accordingly, to solve the problems, the inventors of the present disclosure have derived the following flame hole structures of the combustion apparatus.

Embodiment 1

Figure 3:
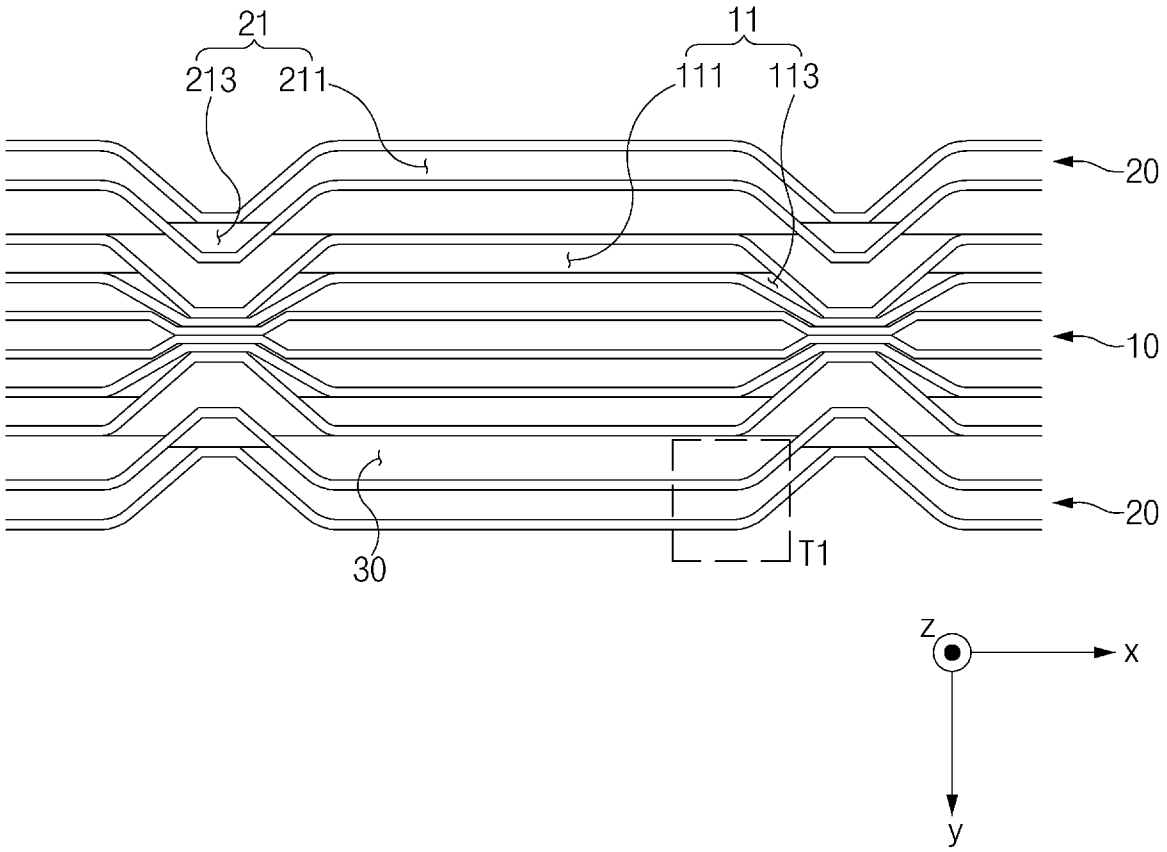
FIG. 3 is a plan view illustrating a flame hole structure according to embodiment 1 of the present disclosure.
Figure 4:
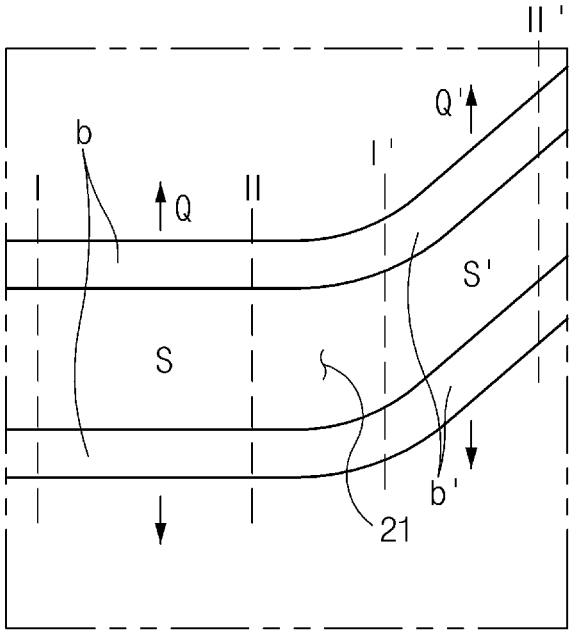
FIG. 4 is an enlarged view illustrating a region T1 in a rich flame hole of FIG. 3.
Figure 5:
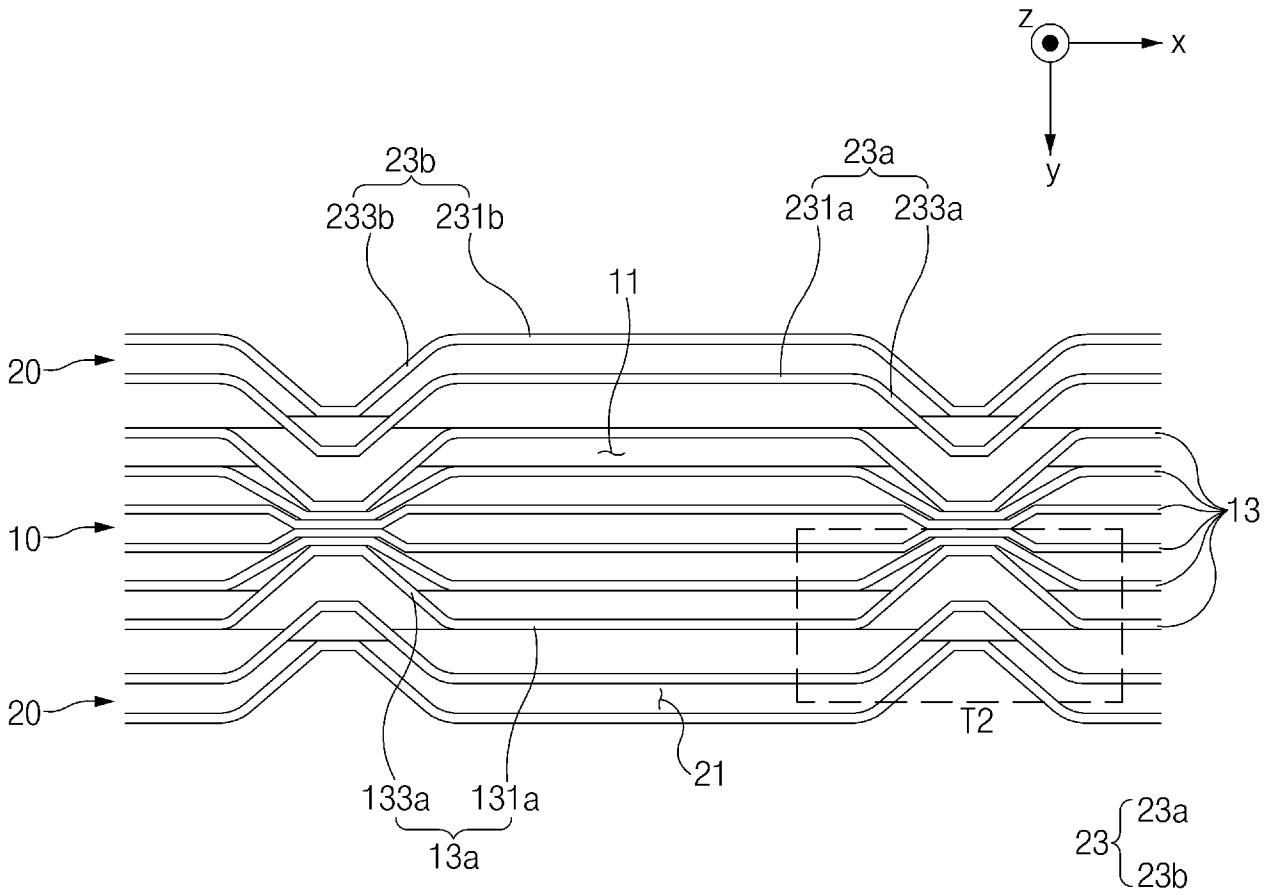
FIG. 5 is a plan view illustrating the flame hole structure according to embodiment 1 of the present disclosure in another aspect.
Figure 6:
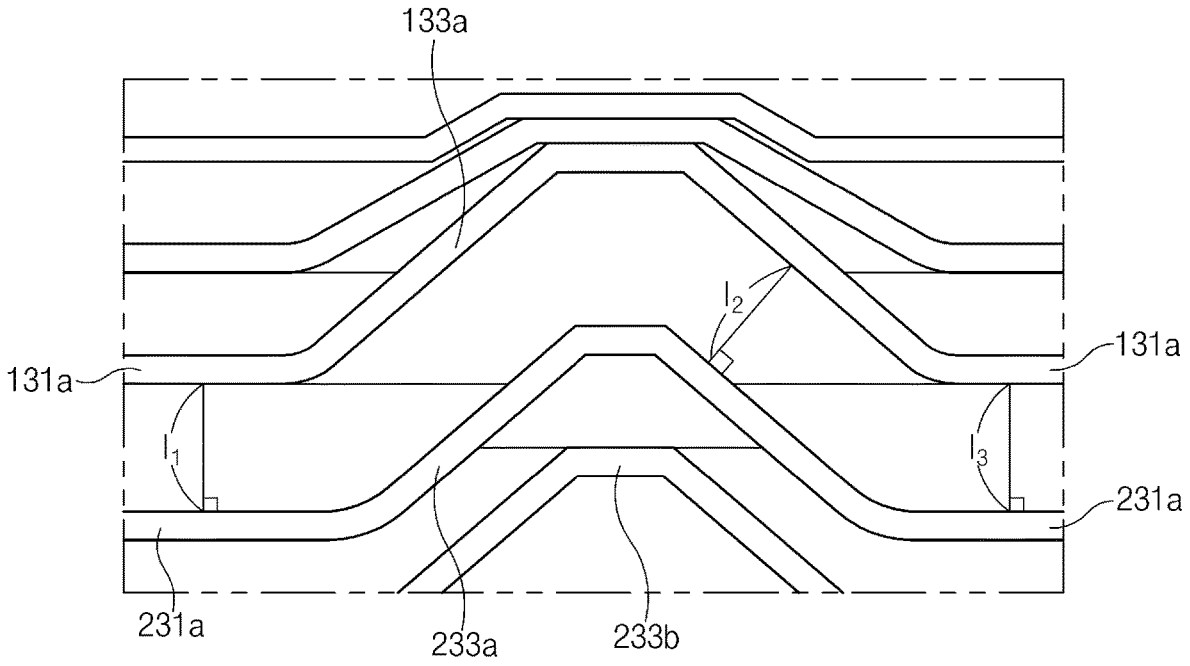
FIG. 6 is an enlarged view illustrating a region T2 of FIG. 5.

FIG. 3 is a plan view illustrating a flame hole structure according to embodiment 1 of the present disclosure. FIG. 4 is an enlarged view illustrating a region T1 in a rich flame hole of FIG. 3. FIG. 5 is a plan view illustrating the flame hole structure according to embodiment 1 of the present disclosure in another aspect. FIG. 6 is an enlarged view illustrating a region T2 of FIG. 5. Hereinafter, a flame hole structure of a combustion apparatus including a plurality of flame holes for forming a flame according to embodiment 1 of the present disclosure will be described with reference to FIGS. 3 to 6.

The flame hole structure according to embodiment 1 of the present disclosure includes a lean flame hole part 10 and a rich flame hole part 20.

The lean flame hole part 10 includes at least one lean flame hole 11 for releasing a lean gas. The lean flame hole 11 extends along a lengthwise direction x that is a direction perpendicular to a release direction z of the lean gas.

The rich flame hole part 20 includes a pair of rich flame holes 21 for releasing a rich gas. The rich flame holes 21 extend along a direction parallel to the lengthwise direction x. At this time, the pair of rich flame holes 21 are provided on opposite sides of the lean flame hole part 10 with respect to a width direction y that is a direction perpendicular to the release direction z and the lengthwise direction x.

The lean gas released from the lean flame hole 11 is burned to form a lean flame, and the rich gas released from the rich flame holes 21 is burned to form a rich flame. Further, a flame stabilizing effect may occur while the lean flame and the rich flame exchange heat with each other.

At this time, the rich flame holes 21 are designed such that the flame stabilizing effect between the lean flame and the rich flame effectively occurs.

For example, each of the rich flame holes 21 includes, between any reference regions having the same size, a region designed such that when the rich flame by the rich gas is generated in the rich flame hole 21, the sum of the amounts of heat transferred to a pair of rich flame hole walls that form each reference region is substantially the same. Alternatively, between any reference regions having the same size, the rich flame hole 21 may be designed such that when a flame by the rich gas is generated, the burning velocity of the rich gas in each reference region is substantially the same.

More specific description will be given with reference to FIG. 4. First, a reference region S refers to a region defined at an upper end of the rich flame hole 21 by a first line I, a second line II, and a pair of rich flame hole walls b. The first and second lines I and II are any virtual lines across the rich flame hole 21, and the rich flame hole walls b refer to walls that are spaced apart from each other along the width direction y and that form a portion of the rich flame hole 21 between the first and second lines I and II.

As illustrated in FIG. 4, any reference regions may be defined in the rich flame hole 21. For example, the reference region S defined by the first line I, the second line II, and the pair of flame hole walls b and a reference region S' defined by a first line I', a second line II', and a pair of flame hole walls b' may be defined.

When the sizes of the reference region S and the reference region S' are the same, the rich flame hole 21 includes, between the reference regions, a region designed such that the sum of the amounts of heat transferred to the pair of rich flame hole walls b or b', that is, the burning velocity of the rich gas in each reference region is substantially the same. In other words, when the sizes of the reference region S and the reference region S' are the same, the rich flame hole 21 includes a region designed such that when a flame by the rich gas is generated, the sum Q of the amounts of heat transferred to the pair of rich flame hole walls b in the reference region S and the sum Q' of the amounts of heat transferred to the pair of rich flame hole walls b' in the reference region S' are substantially the same.

In the reference regions S and S' having the same size, the same amount of rich gas will be released at substantially the same release velocity, and substantially the same amount of heat will be generated when the rich gas is burned. Further, when the amounts of heat transferred from the reference regions S and S' to the flame hole walls b and b' are substantially the same, the burning velocities of the rich gas in the reference regions S and S' will also be substantially the same, and therefore limit conditions in which lifting occurs in the reference regions S and S' will be the same. Accordingly, when the rich gas is supplied to the reference regions S and S' in an optimal condition capable of reducing emission of NOx, rich flames having substantially the same property will be generated in the reference regions S and S'.

Thus, unlike in the regions A and B of FIG. 1, substantially the same flame stabilizing effect may be obtained in the entirety of the region designed as described above. Accordingly, the flame hole structure according to embodiment 1 of the present disclosure may reduce emission of NOx and may enhance the stability of burning, thereby achieving a uniform flame stabilizing effect. Further, the entire region of the rich flame hole is more preferably designed in this way.

Meanwhile, "substantially the same" does not mean "numerically exactly the same", but means the sameness to a degree that substantially the same action is caused in this technical field even though there is a slight numerical difference.

At this time, there may be various means for adjusting the amounts of heat transferred to the flame hole walls that form each reference region.

For example, when the material and thickness of a pair of rich flame hole walls are constant, the rich flame hole 21 may be designed, between any reference regions having the same size, such that the sum of the lengths of upper ends of the pair of rich flame hole walls that form each reference region is substantially the same. That is, in FIG. 4, the rich flame hole 21 may be designed such that the sum of the lengths of the pair of flame hole walls b that form the reference region S and the sum of the lengths of the pair of flame hole walls b' that form the reference region S' are substantially the same. When the sums of the lengths are the same, it may be considered that the areas of the flame hole walls to which heat is transferred are the same.

When the difference between the sum of the lengths of the upper ends of the pair of flame hole walls b that form the reference region S and the sum of the lengths of the upper ends of the pair of flame hole walls b' that form the reference region S' is within an error range of about 15%, the sum of the lengths of the upper ends of the pair of rich flame hole walls that form each reference region may be considered to be substantially the same. The lengths of rich flame hole walls actually manufactured may have a tolerance with design lengths, and even though there is a difference in the sum of the lengths of the upper ends of the pair of rich flame hole walls that form each reference region, the sum of the lengths of the upper ends of the pair of rich flame hole walls that form each reference region may be considered to be substantially the same within the tolerance range that occurs during manufacturing.

Accordingly, it may be considered that in each reference region, the limit condition in which lifting occurs is substantially the same and an equivalent flame stabilizing effect appears. Meanwhile, the numerical value of 15% does not have a special meaning and is an example for representing a range of a tolerance level that occurs during manufacturing.

In another example, even though the distances between the pair of flame hole walls that form the reference regions differ from each other or there is a difference in other properties of the flame hole walls, the thickness and material of the flame hole walls may be adjusted such that the amounts of heat transferred to the flame hole walls are the same.

In another example, when a physical object, such as a binding plate, which is capable of receiving heat exists around a rich flame hole as illustrated in FIG. 1 (*a*), the rich flame hole may be designed, between any reference regions having the same size, such that the sum of the amounts of heat transferred to a physical boundary that includes a pair of flame hole walls and defines each reference region is substantially the same.

Referring again to FIG. 3, the lean flame hole 11 may include at least one bent lean flame hole portion 113 and horizontal lean flame hole portions 111. The bent lean flame hole portion 113 refers to a portion that is bent toward the center of the lean flame hole part 10 along the width direction y. The horizontal lean flame hole portions 111 refer to portions that are provided on opposite sides of the bent lean flame hole portion 113 with respect to the direction parallel to the lengthwise direction x and that extend along the direction parallel to the lengthwise direction x.

Furthermore, the rich flame hole 21 may include at least one protruding rich flame hole portion 213 and horizontal rich flame hole portions 211. The protruding rich flame hole portion 213 refers to a portion that protrudes toward the bent lean flame hole portion 113 to correspond to the bent lean flame hole portion 113. Further, the horizontal rich flame hole portions 211 refer to portions that are provided on opposite sides of the protruding rich flame hole portion 213 with respect to the direction parallel to the lengthwise direction x and that extend along the direction parallel to the lengthwise direction x to correspond to the horizontal lean flame hole portions 111.

As described above, the rich flame hole 21 includes the protruding rich flame hole portion 213 corresponding to the bent lean flame hole portion 113, thereby allowing the rich flame to be formed in a form surrounding the periphery of the lean flame, and an effect of increasing the area in which a flame stabilizing effect occurs may occur.

At this time, the rich flame hole 21 may include a communication region that is a region formed to extend from any one horizontal rich flame hole portion 211 to another horizontal rich flame hole portion 211 through the adjacent protruding rich flame hole portion 213. At this time, in the entire communication region, the rich flame hole 21 may be designed, between the reference regions having the same size, such that the sum of the amounts of heat transferred to the pair of rich flame hole walls that form each reference region is substantially the same.

As illustrated in FIG. 1 (*b*), a lifting phenomenon is likely to occur in the portion where the rich flame hole parts 5 and 6 are disconnected from each other, whereas in the entire communication region of the present disclosure, the limit at which a lifting phenomenon occurs may be substantially the same, and therefore a flame stabilizing effect may be allowed to uniformly appear in a wide region. Furthermore, the rich flame hole 21 is more preferably designed to have a communication region in all the regions where the bent lean flame hole portion 113 and the protruding rich flame hole portion 213 are provided.

Meanwhile, the flame hole structure according to embodiment 1 of the present disclosure may further include a partitioning part 30. The partitioning part 30 refers to a part that is provided between the lean flame hole part 10 and the rich flame hole part 20 and through which the lean gas and the rich gas are not released. The partitioning part 30 may be designed such that the lean flame and the rich flame are formed with an appropriate interval therebetween and a flame stabilizing effect most effectively appears.

At this time, referring to FIGS. 5 and 6, the lean flame hole part 10 may further include a plurality of lean plates 13 for forming the lean flame holes 11, and the rich flame hole part 20 may further include a plurality of rich plates 23 for forming the rich flame holes 21.

The plurality of lean/rich plates 13 and 23 may be disposed to be spaced apart from each other at a predetermined interval while facing each other along the width direction y. Further, the lean/rich flame holes 11 and 21 may be formed in spacing spaces between the lean/rich plates 13 and 23. Furthermore, the partitioning part 30 may be formed between a first lean plate 13*a* located at the outermost position with respect to the width direction y among the plurality of lean plates 13 and a first rich plate 23*a* located at the innermost position with respect to the width direction y among the plurality of rich plates 23.

At this time, the plurality of lean plates 13 may be bent at different angles to form the bent lean flame hole portions 113. Further, the plurality of rich plates 23 may also form the protruding rich flame hole portions 213.

At this time, the first lean plate 13*a* may include at least one first bent lean plate portion 133*a* and first horizontal lean plate portions 131*a* provided on opposite sides of the first bent lean plate portion 133*a*. The first bent lean plate portion 133*a* refers to a portion that is bent toward the center of the lean flame hole part 10 along the width direction y, and the first horizontal lean plate portions 131*a* refer to portions that extend along the direction parallel to the lengthwise direction x from the opposite sides of the first bent lean plate portion 133*a* with respect to the direction parallel to the lengthwise direction x.

Furthermore, the first rich plate 23*a* may include a first protruding rich plate portion 233*a* corresponding to the first bent lean plate portion 133*a* and first horizontal rich plate portions 231*a* corresponding to the first horizontal lean plate portions 131*a*. The first protruding rich plate portion 233*a* protrudes toward the first bent lean plate portion 133*a*, and the first horizontal rich plate portions 231*a* extend from opposite sides of the first protruding rich plate portion 233*a* along the direction parallel to the lengthwise direction x. Further, the second rich plate 23*b* may include a second protruding rich plate portion 233*b* and first horizontal rich plate portions 231*b*.

At this time, as illustrated in FIG. 6, the flame hole structure according to embodiment 1 of the present disclosure may be designed such that the length of a vertical line 12 drawn from any point of at least one first bent lean plate portion 133*a* toward the first protruding rich plate portion 233*a* corresponding thereto is substantially the same as the lengths of vertical lines $I_1$ and $I_3$ drawn from any points of the adjacent first horizontal lean plate portion 131*a* toward the first horizontal rich plate portion 231 corresponding thereto.

That is, the rich flame hole part 20 may be provided to be spaced apart from the lean flame hole part 10 at substantially the same interval in a region extending from at least one horizontal rich flame hole portion 211 to another horizontal rich flame hole portion 211 through the adjacent protruding rich flame hole portion 213 (refer to FIG. 3).

At this time, the same interval does not mean numerically exact sameness. For example, even though the rich flame hole part 20 and the lean flame hole part 10 are designed to be spaced apart from each other by a distance L, when the actual interval is within an error range of about ±30% of the distance L, the rich flame hole part 20 and the lean flame hole part 10 may be considered to be spaced apart from each other by substantially the same interval.

Because the distance between the rich flame hole part and the lean flame hole part in an actual burner structure is very small at the level of 1 mm unit, considering a tolerance generated during manufacturing, it may be considered that the limit condition in which lifting occurs is substantially the same within the error range of about ±30% and an equivalent flame stabilizing effect appears.

For example, when the distance between the actual rich flame hole part and the actual lean flame hole part is within a range of about 0.9 mm to about 1.35 mm, the distance may be considered to be substantially the same. At this time, ±30% or 0.9 mm to 0.35 mm does not have a special meaning as a numerical value itself and is only disclosed as an example for representing a range of substantially the same level, when a manufacturing tolerance is considered.

Accordingly, the interval between the lean flame and the rich flame generated from the bent lean flame hole portion 113 and the protruding rich flame hole portion 213 may be designed to be substantially the same as the interval between the lean flame and the rich flame generated from the horizontal lean flame hole portions 111 and the horizontal rich flame hole portions 211. In the entirety of the region designed in this way, an equivalent flame stabilizing effect may appear because the lean flame and the rich flame are separated from each other by the same interval in the entire region.

Accordingly, for all of the bent lean flame hole portion 113 and the protruding rich flame hole portion 213, the length of a vertical line drawn from any point of the first bent lean plate portion 133*a* toward the first protruding rich plate portion 233*a* corresponding thereto is more preferably designed to be substantially the same as the length of a vertical line drawn from any point of the adjacent first horizontal lean plate portion 131*a* toward the first horizontal rich plate portion 231*a* corresponding thereto. Here, when the lengths of the vertical lines or the intervals between the flames are substantially the same, numerically exact sameness is not required.

Embodiment 2

Figure 7:
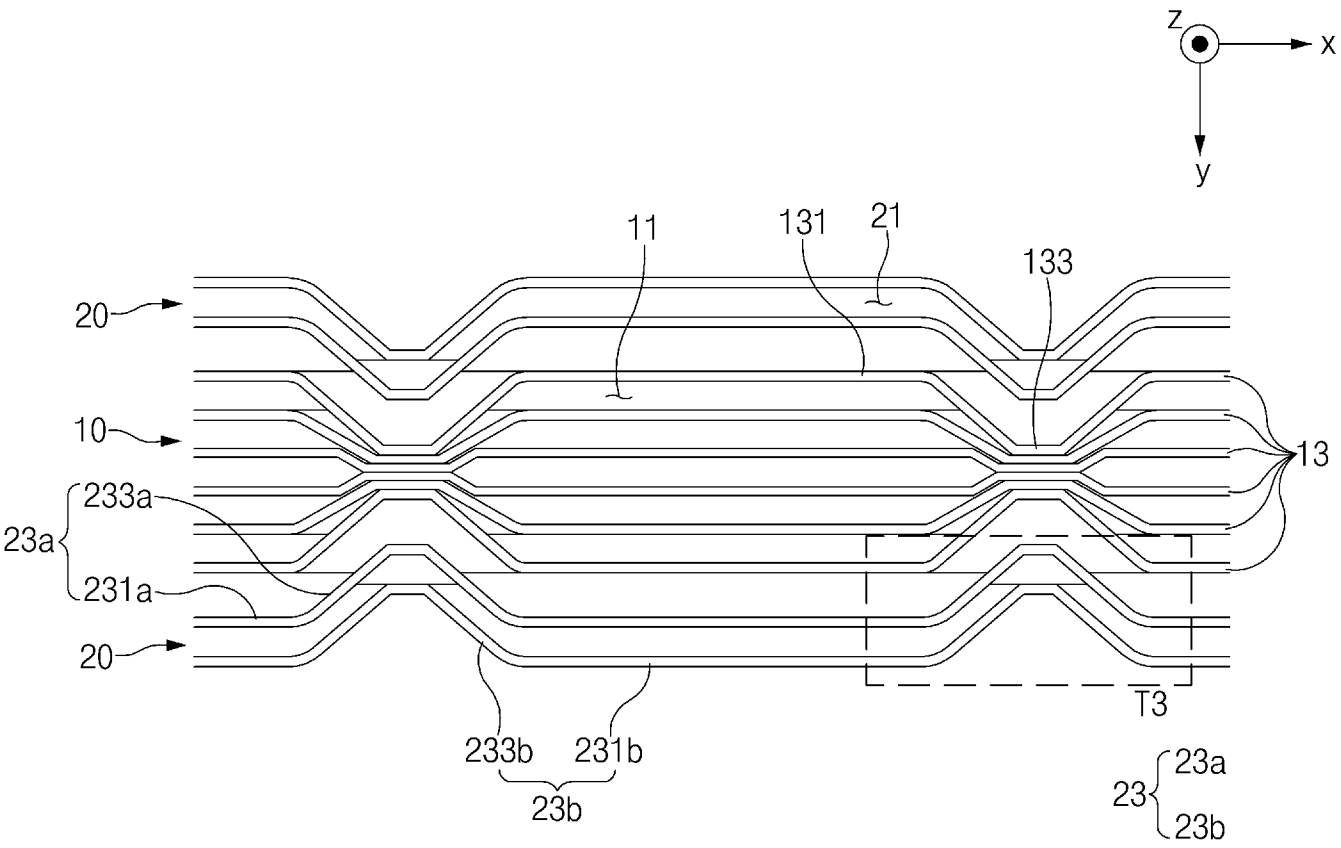
FIG. 7 is a plan view illustrating a flame hole structure according to embodiment 2 of the present disclosure.
Figure 8:
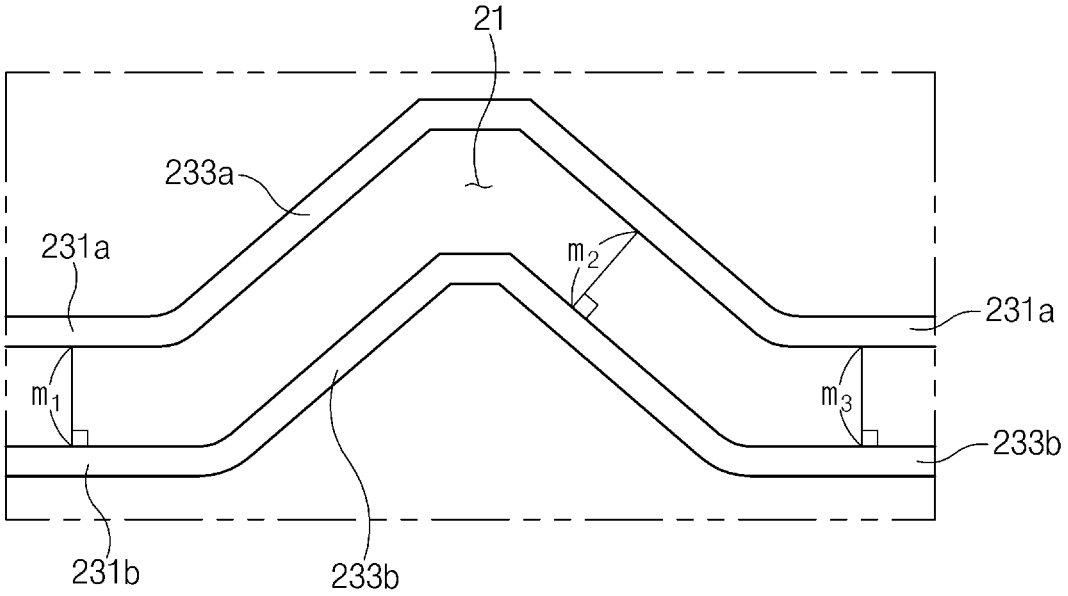
FIG. 8 is an enlarged view illustrating a region T3 of FIG. 7.

FIG. 7 is a plan view illustrating a flame hole structure according to embodiment 2 of the present disclosure. FIG. 8 is an enlarged view illustrating a region T3 of FIG. 7. Hereinafter, the flame hole structure according to embodiment 2 of the present disclosure will be described with reference to FIGS. 7 and 8. In the flame hole structure according to embodiment 2, components identical to those in embodiment 1 will be described using identical reference numerals.

The flame hole structure according to embodiment 2 of the present disclosure includes a lean flame hole part 10 and a rich flame hole part 20, like the flame hole structure according to embodiment 1. The lean flame hole part 10 includes lean flame holes 11 formed by a plurality of lean plates 13 and rich flame holes 21 formed by first and second rich plates 23*a* and 23*b*.

Furthermore, the plurality of lean plates 13 include a bent lean plate portion 133 and a horizontal lean plate portion 131, and the first and second rich plates 23*a* and 23*b* also include first and second protruding rich plate portions 233*a* and 233*b* corresponding to the bent lean plate portion 133 and first and second horizontal rich plate portions 231*a* and 231*b* corresponding to the horizontal lean plate portion 131.

However, the flame hole structure according to embodiment 2 differs from the flame hole structure according to embodiment 1 in terms of the design structure of the rich flame holes 21. More specifically, as illustrated in FIG. 8, the flame hole structure according to embodiment 2 of the present disclosure is designed such that the lengths of vertical lines $m_1$ and $m_3$ drawn from any points of at least one first horizontal rich plate portion 231*a* toward the second horizontal rich plate portion 231*b* are substantially the same as the length of a vertical line $m_2$ drawn from any point of the adjacent first protruding rich plate portion 233*a* toward the second protruding rich plate portion 233*b*.

When the rich flame holes 21 are designed in this way, it may be considered that in the region where the lengths of the vertical lines $m_1$, $m_2$, and $m_3$ identically extend in FIG. 8, as in embodiment 1 of the present disclosure, the amounts of heat transferred to flame hole walls are substantially the same between any reference regions having the same size. In other words, it may be considered that in all regions extending in a straight line shape in the rich flame holes 21, that is, in all regions other than bending regions such as the portions extending from the horizontal rich plate portions 231*a* and 231*b* to the protruding rich plate portions 233*a* and 233*b*, the amounts of heat transferred to flame hole walls between any reference regions are substantially the same.

Further, between any reference region defined in the region extending in a straight line shape and any reference region defined in the bending region, the amounts of heat transferred to flame hole walls may not be substantially the same when the sizes of the reference regions are the same. However, when the rich flame holes 21 are designed as in embodiment 2 of the present disclosure, the difference between the amounts of heat may be insignificant, and a flame stabilizing effect may be considered to substantially identically occur in the entirety of the rich region 21 designed as in embodiment 2 of the present disclosure.

Embodiment 3

Figure 9:
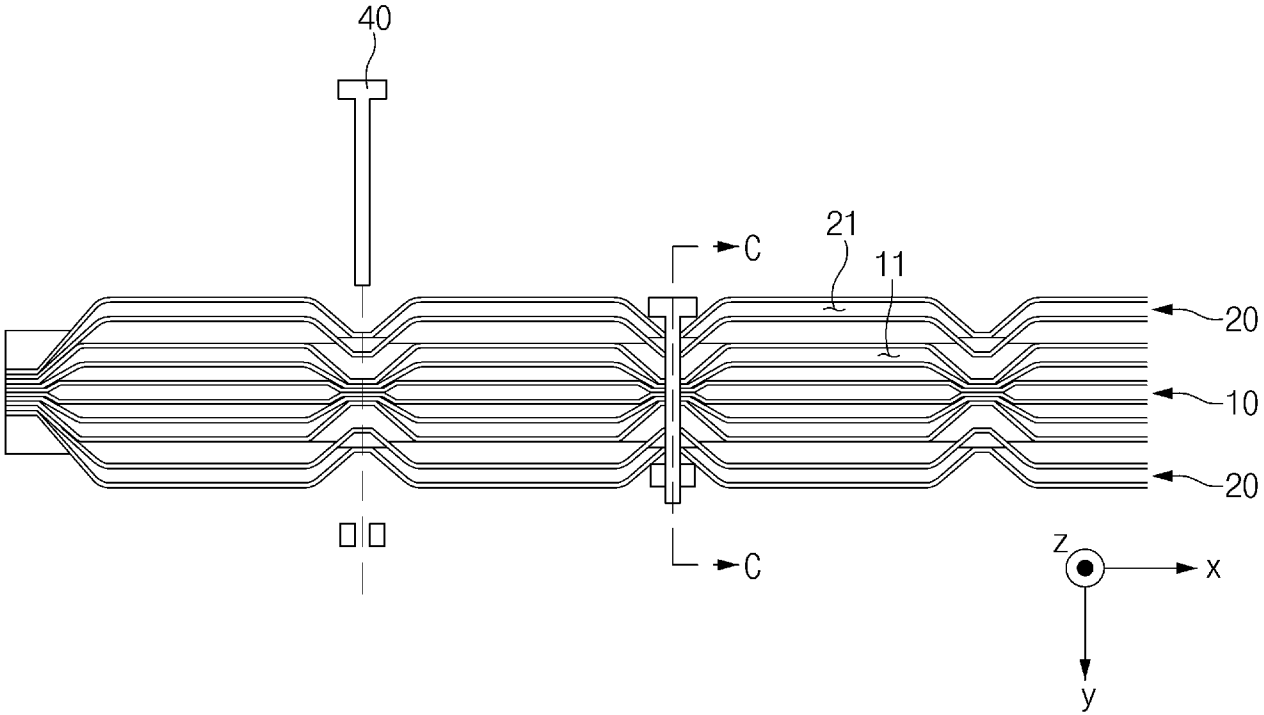
FIG. 9 is a plan view illustrating a flame hole structure according to embodiment 3 of the present disclosure.
Figure 10:
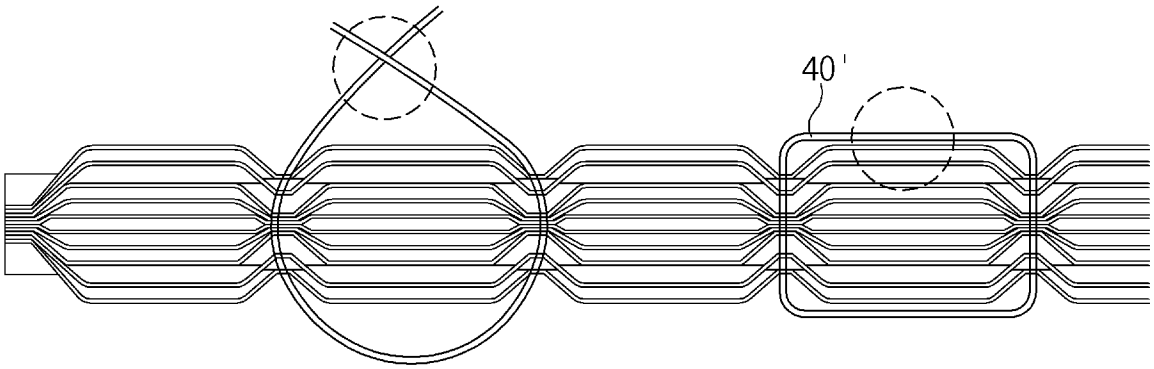
FIG. 10 is a plan view illustrating the flame hole structure according to embodiment 3 of the present disclosure.
Figure 11:
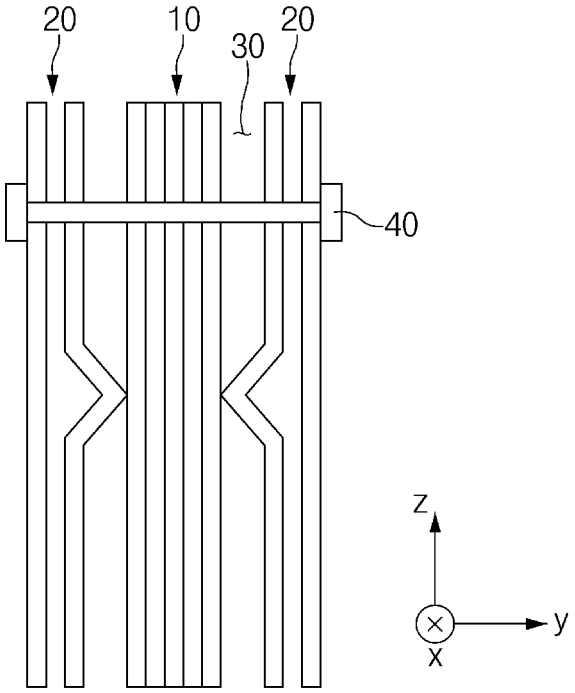
FIG. 11 is a schematic view illustrating a section taken along line C-C in FIG. 9.

FIG. 9 is a plan view illustrating a flame hole structure according to embodiment 3 of the present disclosure. FIG. 10 is a plan view illustrating the flame hole structure according to embodiment 3 of the present disclosure. FIG. 11 is a schematic view illustrating a section taken along line C-C in FIG. 9. Hereinafter, the flame hole structure according to embodiment 3 of the present disclosure will be described with reference to FIGS. 9 to 11. In the flame hole structure according to embodiment 3, components identical to those in embodiments 1 and 2 will be described using identical reference numerals, and unnecessary description will be omitted.

The flame hole structure according to embodiment 3 of the present disclosure may further include a binding member 40 in the flame hole structures according to embodiments 1 and 2. The binding member 40 refers to a member that passes through a rich flame hole part 20 and a lean flame hole part 10 along the width direction y and binds the lean flame hole part 10 and the rich flame hole part 20 together. As the binding member 40 is provided, lean flame holes 11 and rich flame holes 21 may be prevented from being changed in size (widened) when flames are generated in the lean flame holes 11 and the rich flame holes 21.

At this time, the binding member 40 may be provided at a position spaced apart downward from upper ends of the lean flame hole part 10 and the rich flame hole part 20 at a predetermined interval (refer to FIG. 11). As illustrated in FIG. 1 (*a*), in the related art, the binding plate is provided at the upper end of the flame hole, and a flame cannot be generated in the portion where the plate is provided, so that a flame stabilizing effect cannot appear. However, because the binding member 40 according to embodiment 3 of the present disclosure is provided at the position spaced apart downward from the upper ends of the flame hole parts at the predetermined interval with respect to a direction parallel to the release direction z, the binding member 40 may not hinder generation of a flame.

At this time, the interval at which the binding member 40 is spaced apart from the upper ends is not specially limited, and the binding member 40 is preferably spaced to a position where the binding member 40 does not hinder generation of a flame and is capable of most effectively preventing the lean flame holes 11 and the rich flame holes 21 from being changed in size.

Furthermore, the type and the binding method of the binding member 40 are also not specially limited, and as illustrated in FIG. 8, a method of inserting the binding rod 40 from one side along the width direction y and thereafter binding an opposite side using welding or plastic deformation may be used. Alternatively, as illustrated in FIG. 9, a method of allowing a binding wire 40' to pass through and thereafter binding opposite distal ends (portions represented by a dotted circle) through welding, knot, plastic deformation, or the like may be used.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

The invention claimed is:

1. A flame hole structure of a combustion apparatus having a plurality of flame holes for forming a flame, the flame hole structure comprising:

a lean flame hole part having at least one lean flame hole extending along a lengthwise direction that is a direction perpendicular to a release direction of a lean gas, as a flame hole to release the lean gas; and a rich flame hole part having a pair of rich flame holes provided on opposite sides of the lean flame hole part with respect to a width direction that is a direction perpendicular to the release direction and the lengthwise direction, the pair of rich flame holes extending along a direction parallel to the lengthwise direction, as flame holes to release a rich gas, wherein a reference region refers to a region defined at an upper end of each rich flame hole by first and second lines that are any virtual lines across the rich flame hole and a pair of rich flame hole walls spaced apart from each other along the width direction and configured to form a portion of the rich flame hole between the first and second lines, and the rich flame hole includes, between any reference regions having the same size, a region designed such that when a flame by the rich gas is generated, the sum of amounts of heat transferred to a pair of rich flame hole walls configured to form each reference region is substantially the same, wherein the lean flame hole includes at least one bent lean flame hole portion bent toward the center of the lean flame hole part along the width direction and horizontal lean flame hole portions provided on opposite sides of the bent lean flame hole portion with respect to the direction parallel to the lengthwise direction and extending along the direction parallel to the lengthwise direction, wherein the rich flame hole includes at least one protruding rich flame hole portion protruding toward the bent lean flame hole portion to correspond to the bent lean flame hole portion and horizontal rich flame hole portions provided on opposite sides of the protruding rich flame hole portion with respect to the direction parallel to the lengthwise direction and extending along the direction parallel to the lengthwise direction to correspond to the horizontal lean flame hole portions, wherein the rich flame hole includes a communication region that is a region formed to extend from any one horizontal rich flame hole portion to another horizontal rich flame hole portion through the adjacent protruding rich flame hole portion, wherein the rich flame hole part further includes a plurality of rich plates disposed to be spaced apart from each other at a predetermined interval while facing each other along the width direction, and the rich flame hole is formed in a spacing space between the rich plates, and wherein the rich plates are space apart by the communication region.

2. The flame hole structure of claim 1, wherein the rich flame hole includes, between any reference regions having the same size, a region designed such that the sum of lengths of upper ends of a pair of rich flame hole walls configured to form each reference region is substantially the same.

3. The flame hole structure of claim 1, wherein between any reference regions having the same size in the entire region, the at least one communication region is designed such that the sum of amounts of heat transferred to a pair of rich flame hole walls configured to form each reference region is substantially the same.

4. The flame hole structure of claim 1, wherein the lean flame hole part further includes a plurality of lean plates disposed to be spaced apart from each other at a predetermined interval while facing each other along the width direction, and the lean flame hole is formed in a spacing space between the lean plates, wherein the flame hole structure further comprises a partitioning part formed between a first lean plate located at the outermost position with respect to the width direction among the plurality of lean plates and a first rich plate located at the innermost position with respect to the width direction among the plurality of rich plates, the partitioning part configured not to release the lean gas and the rich gas.

5. The flame hole structure of claim 4, wherein the first lean plate includes at least one first bent lean plate portion bent toward the center of the lean flame hole part along the width direction and first horizontal lean plate portions extending from opposite sides of the first bent lean plate portion with respect to the direction parallel to the lengthwise direction along the direction parallel to the lengthwise direction, wherein the first rich plate includes at least one first protruding rich plate portion protruding toward the first bent lean plate portion to correspond to the first bent lean plate portion and first horizontal rich plate portions extending from opposite sides of the first protruding rich plate portion with respect to the direction parallel to the lengthwise direction along the direction parallel to the lengthwise direction to correspond to the first horizontal lean plate portions, and wherein a length of a vertical line drawn from any point of the at least one first bent lean plate portion toward the first protruding rich plate portion corresponding thereto is designed to be substantially the same as a length of a vertical line drawn from any point of the adjacent first horizontal lean plate portion toward the first horizontal rich plate portion corresponding thereto.

6. The flame hole structure of claim 1, further comprising:

a binding member configured to pass through the rich flame hole part and the lean flame hole part along the width direction and bind the lean flame hole part and the rich flame hole part together.

7. The flame hole structure of claim 6, wherein the binding member is provided at a position spaced apart downward from upper ends of the lean flame hole part and the rich flame hole part at a predetermined interval with respect to a direction parallel to the release direction.

8. A flame hole structure of a combustion apparatus having a plurality of flame holes for forming a flame, the flame hole structure comprising:

a lean flame hole part having at least one lean flame hole extending along a lengthwise direction that is a direction perpendicular to a release direction of a lean gas, as a flame hole to release the lean gas; and a rich flame hole part having a pair of rich flame holes provided on opposite sides of the lean flame hole part with respect to a width direction that is a direction perpendicular to the release direction and the lengthwise direction, the pair of rich flame holes extending along a direction parallel to the lengthwise direction, as flame holes to release a rich gas, wherein the lean flame hole includes at least one bent lean flame hole portion bent toward the center of the lean flame hole part along the width direction and horizontal lean flame hole portions provided on opposite sides of the bent lean flame hole portion with respect to the direction parallel to the lengthwise direction and extending along the direction parallel to the lengthwise direction, wherein the rich flame hole includes at least one protruding rich flame hole portion protruding toward the bent lean flame hole portion to correspond to the bent lean flame hole portion and horizontal rich flame hole portions provided on opposite sides of the protruding rich flame hole portion with respect to the direction parallel to the lengthwise direction and extending along the direction parallel to the lengthwise direction to correspond to the horizontal lean flame hole portions, wherein in a region extending from at least any one horizontal rich flame hole portion to another horizontal rich flame hole portion through the adjacent protruding rich flame hole portion, the rich flame hole part is provided to be spaced apart from the lean flame hole part by substantially the same interval, and wherein the rich flame hole includes a communication region that is a region formed to extend from any one horizontal rich flame hole portion to another horizontal rich flame hole portion through the adjacent protruding rich flame hole portion, wherein the rich flame hole part further includes a plurality of rich plates disposed to be spaced apart from each other at a predetermined interval while facing each other along the width direction, and the rich flame hole is formed in a spacing space between the rich plates, and wherein the rich plates are space apart by the communication region.

9. A flame hole structure of a combustion apparatus having a plurality of flame holes for forming a flame, the flame hole structure comprising:

a lean flame hole part extending along a lengthwise direction and having at least one lean flame hole configured to release a lean gas; and a rich flame hole part having a pair of rich flame holes provided on opposite sides of the lean flame hole part with respect to a width direction associated with the lengthwise direction, the pair of rich flame holes extending along a direction parallel to the lengthwise direction to release a rich gas, wherein a reference region refers to a region defined at an upper end of each rich flame hole by first and second lines that are any virtual lines across the rich flame hole and a pair of rich flame hole walls spaced apart from each other along the width direction and configured to form a portion of the rich flame hole between the first and second lines, and between any reference regions having the same size, the rich flame hole is designed such that when a flame by the rich gas is generated, the sum of amounts of heat transferred to physical boundaries configured to define each reference region is substantially the same, wherein the lean flame hole includes at least one bent lean flame hole portion bent toward the center of the lean flame hole part along the width direction and horizontal lean flame hole portions provided on opposite sides of the bent lean flame hole portion with respect to the direction parallel to the lengthwise direction and extending along the direction parallel to the lengthwise direction, and wherein the rich flame hole includes at least one protruding rich flame hole portion protruding toward the bent lean flame hole portion to correspond to the bent lean flame hole portion and horizontal rich flame hole portions provided on opposite sides of the protruding rich flame hole portion with respect to the direction parallel to the lengthwise direction and extending along the direction parallel to the lengthwise direction to correspond to the horizontal lean flame hole portions, wherein the rich flame hole includes a communication region that is a region formed to extend from any one horizontal rich flame hole portion to another horizontal rich flame hole portion through the adjacent protruding rich flame hole portion, wherein the rich flame hole part further includes a plurality of rich plates disposed to be spaced apart from each other at a predetermined interval while facing each other along the width direction, and the rich flame hole is formed in a spacing space between the rich plates, and wherein the rich plates are space apart by the communication region.

10. A flame hole structure of a combustion apparatus having a plurality of flame holes for forming a flame, the flame hole structure comprising:

a lean flame hole part extending along a lengthwise direction and having at least one lean flame hole configured to release a lean gas; and a rich flame hole part having a pair of rich flame holes provided on opposite sides of the lean flame hole part with respect to a width direction associated with the lengthwise direction, the pair of rich flame holes extending along a direction parallel to the lengthwise direction to release a rich gas, wherein the lean flame hole includes at least one bent lean flame hole portion bent toward the center of the lean flame hole part along the width direction and horizontal lean flame hole portions provided on opposite sides of the bent lean flame hole portion with respect to the direction parallel to the lengthwise direction and extending along the direction parallel to the lengthwise direction, wherein the rich flame hole includes at least one protruding rich flame hole portion protruding toward the bent lean flame hole portion to correspond to the bent lean flame hole portion and horizontal rich flame hole portions provided on opposite sides of the protruding rich flame hole portion with respect to the direction parallel to the lengthwise direction and extending along the direction parallel to the lengthwise direction to correspond to the horizontal lean flame hole portions, wherein a reference region refers to a region defined at an upper end of each rich flame hole by first and second lines that are any virtual lines across the rich flame hole and a pair of rich flame hole walls spaced apart from each other along the width direction and configured to form a portion of the rich flame hole between the first and second lines, and between any reference regions having the same size, the rich flame hole is designed such that the sum of lengths of upper ends of a pair of rich flame hole walls configured to form each reference region is substantially the same, and wherein the rich flame hole includes a communication region that is a region formed to extend from any one horizontal rich flame hole portion to another horizontal rich flame hole portion through the adjacent protruding rich flame hole portion, wherein the rich flame hole part further includes a plurality of rich plates disposed to be spaced apart from each other at a predetermined interval while facing each other along the width direction, and the rich flame hole is formed in a spacing space between the rich plates, and wherein the rich plates are space apart by the communication region.

11. A flame hole structure of a combustion apparatus having a plurality of flame holes for forming a flame, the flame hole structure comprising:

a lean flame hole part extending along a lengthwise direction and having at least one lean flame hole configured to release a lean gas; and a rich flame hole part having a pair of rich flame holes provided on opposite sides of the lean flame hole part with respect to a width direction associated with the lengthwise direction, the pair of rich flame holes extending along a direction parallel to the lengthwise direction to release a rich gas, wherein a reference region refers to a region defined at an upper end of each rich flame hole by first and second lines that are any virtual lines across the rich flame hole and a pair of rich flame hole walls spaced apart from each other along the width direction and configured to form a portion of the rich flame hole between the first and second lines, and between any reference regions having the same size, the rich flame hole is designed such that when a flame by the rich gas is generated, a burning velocity of the rich gas in each reference region is substantially the same, wherein the lean flame hole includes at least one bent lean flame hole portion bent toward the center of the lean flame hole part along the width direction and horizontal lean flame hole portions provided on opposite sides of the bent lean flame hole portion with respect to the direction parallel to the lengthwise direction and extending along the direction parallel to the lengthwise direction, and wherein the rich flame hole includes at least one protruding rich flame hole portion protruding toward the bent lean flame hole portion to correspond to the bent lean flame hole portion and horizontal rich flame hole portions provided on opposite sides of the protruding rich flame hole portion with respect to the direction parallel to the lengthwise direction and extending along the direction parallel to the lengthwise direction to correspond to the horizontal lean flame hole portions, wherein the rich flame hole includes a communication region that is a region formed to extend from any one horizontal rich flame hole portion to another horizontal rich flame hole portion through the adjacent protruding rich flame hole portion, wherein the rich flame hole part further includes a plurality of rich plates disposed to be spaced apart from each other at a predetermined interval while facing each other along the width direction, and the rich flame hole is formed in a spacing space between the rich plates, and wherein the rich plates are space apart by the communication region.

12. A flame hole structure of a combustion apparatus having a plurality of flame holes for forming a flame, the flame hole structure comprising:

a lean flame hole part having a lean flame hole formed in a spacing space between a plurality of lean plates as a flame hole to release a lean gas, the plurality of lean plates being disposed to be spaced apart from each other while facing each other along a width direction that is a direction that is perpendicular to a release direction of the lean gas and is also perpendicular to a lengthwise direction that is a direction perpendicular to the release direction; and a rich flame hole part having rich flame holes provided on opposite sides of the lean flame hole part with respect to the width direction as flame holes to release a rich gas, each rich flame hole being formed in a spacing space between first and second rich plates disposed to be spaced apart from each other at a predetermined interval while facing each other along the width direction, wherein the lean flame hole includes at least one bent lean flame hole portion bent toward the center of the lean flame hole part along the width direction and horizontal lean flame hole portions provided on opposite sides of the bent lean flame hole portion with respect to the direction parallel to the lengthwise direction and extending along the direction parallel to the lengthwise direction, wherein the rich flame hole includes at least one protruding rich flame hole portion protruding toward the bent lean flame hole portion to correspond to the bent lean flame hole portion and horizontal rich flame hole portions provided on opposite sides of the protruding rich flame hole portion with respect to the direction parallel to the lengthwise direction and extending along the direction parallel to the lengthwise direction to correspond to the horizontal lean flame hole portions, wherein the plurality of lean plates include at least one bent lean plate portion bent toward the center of the lean flame hole part along the width direction and horizontal lean plate portions extending from opposite sides of the bent lean plate portion with respect to a direction parallel to the lengthwise direction along the direction parallel to the lengthwise direction, wherein the first and second rich plates include at least one first protruding rich plate portion and at least one second protruding rich plate portion protruding toward the bent lean plate portion to correspond to the bent lean plate portion and first and second horizontal rich plate portions extending from opposite sides of the first and second protruding rich plate portions with respect to the direction parallel to the lengthwise direction along the direction parallel to the lengthwise direction to correspond to the horizontal lean plate portions, wherein a length of a vertical line drawn from any point of at least one first horizontal rich plate portion toward the second horizontal rich plate portion is designed to be substantially the same as a length of a vertical line drawn from any point of the adjacent first protruding rich plate portion toward the second protruding rich plate portion, and wherein the rich flame hole includes a communication region that is a region formed to extend from any one horizontal rich flame hole portion to another horizontal rich flame hole portion through the adjacent protruding rich flame hole portion, wherein the rich flame hole part further includes a plurality of rich plates disposed to be spaced apart from each other at a predetermined interval while facing each other along the width direction, and the rich flame hole is formed in a spacing space between the rich plates, and wherein the rich plates are space apart by the communication region.

* * * * *